US011230898B2

(12) United States Patent
Telfer

(10) Patent No.: US 11,230,898 B2
(45) Date of Patent: Jan. 25, 2022

(54) WELL ABANDONMENT AND SLOT RECOVERY

(71) Applicant: ARDYNE HOLDINGS LIMITED, Aberdeen (GB)

(72) Inventor: George Telfer, Aberdeen (GB)

(73) Assignee: ARDYNE HOLDINGS LIMITED, Aberdeen (GB)

( * ) Notice: Subject to any disclaimer, the term of this patent is extended or adjusted under 35 U.S.C. 154(b) by 95 days.

(21) Appl. No.: 16/481,882

(22) PCT Filed: Jan. 31, 2018

(86) PCT No.: PCT/GB2018/050274
§ 371 (c)(1),
(2) Date: Jul. 30, 2019

(87) PCT Pub. No.: WO2018/142123
PCT Pub. Date: Aug. 9, 2018

(65) Prior Publication Data

US 2019/0390527 A1 Dec. 26, 2019

(30) Foreign Application Priority Data

Feb. 1, 2017 (GB) ..... 1701644
Feb. 1, 2017 (GB) ..... 1701649

(51) Int. Cl.
*E21B 29/00* (2006.01)
*E21B 33/134* (2006.01)
(Continued)

(52) U.S. Cl.
CPC ..... *E21B 29/005* (2013.01); *E21B 23/04* (2013.01); *E21B 33/134* (2013.01); *E21B 29/02* (2013.01); *E21B 47/10* (2013.01)

(58) Field of Classification Search
CPC ..... E21B 29/002; E21B 29/005; E21B 29/02; E21B 33/134; E21B 33/138
See application file for complete search history.

(56) References Cited

U.S. PATENT DOCUMENTS 2,100,684 A 11/1937 Carroll
2,136,518 A 11/1938 Nixon
(Continued)

FOREIGN PATENT DOCUMENTS

EP 3085882 A1 10/2016
WO 2004027204 A2 4/2004
(Continued)

OTHER PUBLICATIONS

"Isolating Potential Flow Zones During Well Construction"; American Petroleum Institute; Standard 65; Part 2, Second Edition; Dec. 2010.

(Continued)

*Primary Examiner* — Cathleen R Hutchins
(74) *Attorney, Agent, or Firm* — Law Office of Jesse D. Lambert, LLC

(57) ABSTRACT

Method and apparatus for single-trip cementing and casing cutting for well abandonment and slot recovery. Using a tool string including a casing cutter and a stinger, where the casing cutter has a central through bore including a wall to isolate the cutting assembly from the cement, cement can be passed through the cutter and deposited using the stinger to form a plug. Embodiments of casing cutters are provided for parting an upper length of casing from a lower length of casing.

14 Claims, 6 Drawing Sheets

(51) Int. Cl.

| | |
|---|---|
| ***E21B 23/04*** | (2006.01) |
| ***E21B 29/02*** | (2006.01) |
| *E21B 47/10* | (2012.01) |

(56) References Cited

U.S. PATENT DOCUMENTS

| | | | | |
|---|---|---|---|---|
| 3,051,254 | A * | 8/1962 | McClinton | E21B 31/14 175/257 |
| 3,073,389 | A | 1/1963 | Conner | |
| 3,196,961 | A * | 7/1965 | Kammerer | E21B 33/134 175/267 |
| 3,283,834 | A | 11/1966 | Kammerer | |
| 3,289,760 | A | 12/1966 | Kammerer | |
| 3,454,090 | A | 7/1969 | Brown | |
| 4,531,583 | A | 7/1985 | Revett | |
| 4,893,675 | A * | 1/1990 | Skipper | E21B 10/322 166/55.8 |
| 4,941,535 | A | 7/1990 | Porter et al. | |
| 5,150,755 | A | 9/1992 | Cassel et al. | |
| 6,026,899 | A | 2/2000 | Arizmendi et al. | |
| 8,839,864 | B2 | 9/2014 | Beynon | |
| 8,955,597 | B2 | 2/2015 | Connell et al. | |
| 9,089,928 | B2 * | 7/2015 | Zediker | B23K 26/0652 |
| 10,487,605 | B2 * | 11/2019 | Nelson | E21B 33/12 |
| 2015/0007991 | A1 | 1/2015 | Larsen et al. | |
| 2015/0053405 | A1 * | 2/2015 | Bakken | E21B 33/14 166/285 |
| 2015/0275605 | A1 | 10/2015 | Bennett et al. | |
| 2016/0305220 | A1 | 10/2016 | Fraser et al. | |
| 2016/0319619 | A1 | 11/2016 | Hekelaar | |
| 2017/0022773 | A1 | 1/2017 | O'Rourke et al. | |
| 2018/0100373 | A1 * | 4/2018 | Kruger | E21B 29/002 |

FOREIGN PATENT DOCUMENTS

| | | | | |
|---|---|---|---|---|
| WO | 2007079321 | A2 | 7/2007 | |
| WO | WO2015/153655 | * | 8/2015 | E21B 23/01 |
| WO | 2018140871 | A1 | 8/2018 | |

OTHER PUBLICATIONS

Halliburton Casing Equipment Brochure; 2015.

Herndon et al.; "Plugging Wells For Abandonment"; Prepared for Union Carbide Corp., Nuclear DIV., Office of Waste Isolation, Oak Ridge, TN; Sep. 1976.

International Search Report dated Jun. 7, 2018 for PCT/GB2018/050273.

International Search Report dated Jun. 6, 2018 for PCT/GB2018/050274.

European Patent Office, Third Party Observations in connection with EP18708170.8; Mar. 10, 2021; all pages; European Patent Office, Munich, Germany.

* cited by examiner

WELL ABANDONMENT AND SLOT RECOVERY

FIELD OF THE INVENTION

Background of the Invention

The present invention relates to methods and apparatus for well abandonment and slot recovery and in particular, through not exclusively, to a method and apparatus for single-trip cementing and casing cutting.

When a well has reached the end of its commercial life, the well is abandoned according to strict regulations in order to prevent fluids escaping from the well on a permanent basis. In meeting the regulations it has become good practise to create the cement plug over a predetermined length of the well and to remove the casing. Current techniques to achieve this may require multiple trips into the well, for example: to set a bridge plug to support cement; to create a cement plug in the casing; to cut the casing above the cement plug; and to pull the casing from the well. A further trip can then be made to cement across to the well bore wall. The cement or other suitable plugging material forms a permanent barrier to meet the legislative requirements.

Each trip into a well takes substantial time and consequently significant costs. Combined casing and pulling tools have been developed so that the cutting and pulling can be achieved on a single trip.

Casing cutting tools typically comprise three or four blades which are initially held in a tool body and then actuated to expand radially outwards from an outer surface of the tool to contact and sever the casing. In order to provide sufficient force at the cutting surface, actuation is commonly achieved by fluid pressure against a piston arranged centrally in the bore of the tool body, with the blade ends lying across the central bore to be swung outwards to radially extend from the tool. Fluid pumped through the tool body is then used to wash away cuttings and swarf as the blades are rotated to sever the casing. Such an arrangement is not suited to the pumping of cement through the tool body as this would damage the blades and inhibit operation of the cutting action.

It is therefore an object of the present invention to provide a method in which cementing and casing cutting is performed on a single trip into the well.

It is a further object of the present invention to provide a casing cutting tool through which cement can be pumped which obviates or mitigates one or more disadvantages of the prior art.

SUMMARY OF THE INVENTION

According to a first aspect of the present invention there is provided a method comprising, in a single trip in a well bore, the steps:

(a) running a tool string downhole in the well bore, the tool string including a casing cutter and a stinger;

(b) passing a fluidised plugging material through the casing cutter and the stinger to deposit a quantity of the fluidised plugging material into the well bore to form a plug;

(c) drawing the stinger out of at least a portion of the deposited fluidised plugging material; and (d) using the casing cutter to part an upper length of casing from a lower length of casing.

In this patent application a stinger is considered to be a length of tubing having a diameter smaller than the diameter of the tool string from which it extends and its diameter is selected to provide a sufficient annular cross-sectional area around the stinger to prevent displacement of fluids and other debris into the deposit of fluidised plugging material.

In this way, the steps of creating a good cement plug and in cutting the casing are undertaken on the same trip into the well bore.

Preferably, the method includes the step of pulling the upper length of casing out of the well bore on the same trip into the well bore. In this way, a further trip into the well bore is saved.

The method may include the step of continuing to pull the tool string after step (c) to position the casing cutter at a desired location for step (d). In this way, casing cutting can be performed at any desired location above the plug.

Preferably, the method includes the additional steps of including a bridge plug on the tool string and setting the bridge plug in the well bore before step (b). The bridge plug may be connected at a lower end of the stinger. In this way, a further trip into the well bore is saved.

The method may include the step of conducting an inflow test before step (b). Alternatively, the method may include the step of conducting a positive pressure test. In this way, the bridge plug that has just been set or a bridge plug which was run on a previous trip into the well can be tested to verify there is no flow through the bridge plug.

Step (b) may include pumping the fluidised plugging material from surface. The preferred fluidised plugging material is cement, but may be any suitable fluidised material which will set to form a permanent barrier to fluid flow therethrough. Alternatively, the tool string may include a receptacle for holding a plugging material and step (c) includes releasing the plugging material from the receptacle to pass as fluidised plugging material through the casing cutter.

Preferably, the method includes the step of pumping a separation member behind the quantity of the fluidised plugging material. The separation member may be a sponge ball, dart or the like as is known to those skilled in the art. In this way, the inner surface of a bore through the casing cutter can be cleaned and a positive signal can be received at surface when the fluidised plugging material is released from the tool string.

The method may include pumping a wash fluid through the tool string and casing cutter. In this way, the fluidised plugging material may be removed from the casing cutter and tool string and/or the wellbore can be cleaned prior to cementing and/or casing cutting.

The method may include directing at least a portion of the wash fluid through at least one port in the casing cutter. In this way, the wash fluid can be used to assist in the removal of cuttings and debris when casing cutting is taking place.

The method may include the step of pulling the casing between steps (c) and (d). In this way, the casing can be held in tension while the casing cutter is operated.

Preferably, in step (d) the casing is severed by making a circumferential cut through the casing. In this embodiment the casing cutter is a pipe cutter. Alternatively, in step (d) the casing is milled over a length of the casing. In this embodiment the casing cutter is a section mill. Those skilled in the art will realise that other methods of casing cutting may be used such as jet cutting, laser cutting and chemical cutting.

The method may include the further steps of pulling the tool string to a second location, at a shallower depth, in the well and repeating step (d). In this way, if the casing cannot be pulled at the first location, a cut can be made higher in the well and the casing pulled at the higher location to achieve casing removal. This can advantageously be performed on the same trip into the well.

According to a second aspect of the present invention there is provided a downhole tool, comprising:

a substantially tubular body having a first end configured for connection in a tool string;

a cutting assembly, the assembly being arranged in an annulus of the body;

a wall arranged between the cutting assembly and a central through bore of the body to isolate the cutting assembly from fluids in the central through bore;

and a stinger connected to a second end of the body, the stinger being a tubular member extending from the tubular body and having an outer diameter smaller than an outer diameter of the tubular body.

By locating the entire cutting assembly in an annulus of the tool body and providing a wall between them, cutter blades and the operating system for them can be advantageously kept from being impaired by the cement while the stinger gives improved placement of the cement.

The cutting assembly may be selected from a group comprising: a pipe cutter, section mill, jet cutter, laser cutter or chemical cutter. In this way, any means which can achieve parting of an upper length of casing from a lower length of casing, can be used.

Preferably, the cutting assembly comprises a plurality of cutting members arranged equidistantly around the tubular body. Preferably each cutting member includes a cutting surface, the surface including tungsten carbide. In this way, the tool will be able to sever and/or mill casing.

Preferably, each cutting member is pivotally mounted in the annulus of the tool body. In this way, the cutting members can move radially outwards from the outer surface of the tool body. Preferably, the pivot is arranged at an end opposite a cutting apex of the cutting member. In this way, the cutting member can be rotated between a first position to sit within the annulus and a second position to extend radially from the body.

Preferably, the casing cutter is operable in a first configuration: wherein the cutter assembly is deactivated and fluidised plugging material pumped through the bore is isolated from the cutter assembly; and a second configuration: wherein the cutter assembly is activated to part an upper length of casing from a lower length of casing.

Preferably, the wall is a cylindrical member moveable longitudinally in the tool body. In this way, the inner wall can be moved after cement flow and access to the cutting assembly is obtained if desired.

Preferably, movement of the cylindrical member activates the cutting assembly. In this way, by preventing movement of the cylindrical member it can be assured that cement does not reach the cutting assembly until it is activated.

Preferably the tool includes a choke. In this way, operation of the choke can allow the cylindrical member to be moved. Preferably, the choke is a reduction in the cross-sectional flow area through the central bore. More preferably, the choke is activated by causing a blockage in the central bore at the choke. This may be done by dropping a ball (sponge, plastic or metal) through the central bore from surface. The choke may include a drop ball seat. In this way, the ball (or dart) may be held in the tool body and retrieved to surface. Advantageously, the ball is a sponge ball. In this way, the ball can clean the inner surface of the central bore to remove the cement.

More preferably, the movement of the cylindrical member opens one or more ports from the central bore to the outer surface of the tool body. In this way, a fluid flow path is provided to allow wash fluid to aid the removal of cuttings.

Preferably, the port(s) are arranged adjacent the cutting assembly. In this way, the wash fluid can be directed to the location of the cut.

Advantageously, there is a venturi located in a fluid pathway between the central bore and the one or more ports. In this way, the direction of fluid flow between the central bore and the outer surface can be controlled. More particularly, the one or more ports are located on a first side of the cutting assembly and one or more apertures are located on an opposite side of the cutting assembly, wherein fluid passageways from the ports and apertures meet at the venturi. In this way, the restricted flow path at the venturi causes a pressure differential sufficient to draw fluid through the aperture(s). Preferably, the aperture(s) are below the cutting assembly so that the fluid from the ports is drawn down the well bore through the aperture(s) in a reverse circulation path with the fluid travelling from the central bore to the ports. In this way, cuttings are drawn down the well bore and may fall out to be left in the well, avoiding the need to dispose of them when brought to surface. Cuttings which don't fall out may be drawn in to the tool body through the aperture(s) in the reverse circulation path. Preferably, there is a filter in the fluid passageway from the apertures. In this way, cuttings can be collected in the tool body.

In the description that follows, the drawings are not necessarily to scale. Certain features of the invention may be shown exaggerated in scale or in somewhat schematic form, and some details of conventional elements may not be shown in the interest of clarity and conciseness. It is to be fully recognized that the different teachings of the embodiments discussed below may be employed separately or in any suitable combination to produce the desired results.

Accordingly, the drawings and descriptions are to be regarded as illustrative in nature, and not as restrictive. Furthermore, the terminology and phraseology used herein is solely used for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes.

All numerical values in this disclosure are understood as being modified by "about". All singular forms of elements, or any other components described herein including (without limitations) components of the apparatus are understood to include plural forms thereof.

BRIEF DESCRIPTION OF THE DRAWINGS

Embodiments of the present invention will now be described, by way of example only, with reference to the accompanying drawings of which.

DETAILED DESCRIPTION OF THE INVENTION

Figures 1A, 1B, 1C, 1D, 1E:
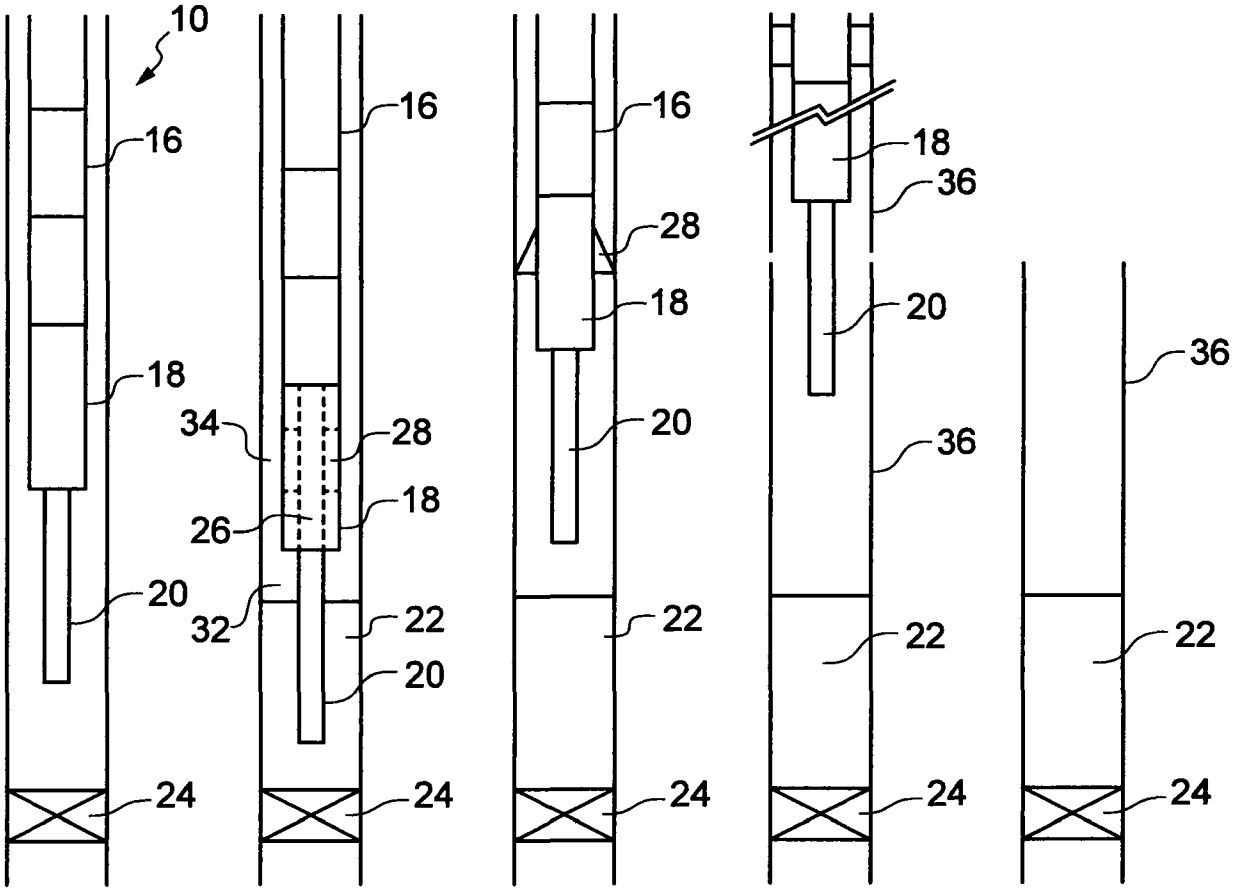
FIGS. 1(*a*) to 1(*e*) illustrate a method, carried out on a single trip in a well bore, according to an embodiment of the present invention.

Reference is initially made to FIG. 1 of the drawings which illustrates a method of placing a cement plug and cutting casing, carried out on a single trip, in a well bore according to an embodiment of the present invention. In FIG. 1(*a*) there is shown a cased well bore, generally indicated by reference numeral 10, in which casing 12 lines the bore 14. A tool string 16 is run in the casing 12. Tool string 16 includes a casing cutter 18 and a stinger 20.

Casing cutter 18 may be any tool which is capable of cutting casing downhole in a well bore. A pipe cutter, section mill, jet cutter, laser cutter and chemical cutter are a non-exhaustive list of possible casing cutters.

Stinger 20 is a length of tubing having a diameter smaller than the diameter of the tool string from which it extends and its diameter is selected to provide a sufficient annular cross-sectional area around the stinger to prevent displacement of fluids and other debris into the deposit of fluidised plugging material. The stinger 20 may be considered as a probe or tailpipe and any structure which provides the equivalent function may be used.

It will be recognised that other tools such as a packer, anchor/grapple and/or washing tool may be incorporated on the tool string 16. Such tools are not illustrated on the figure merely to aid clarity.

Tool string 16 is run into the casing 12 by standard methods to a location in the well bore 10 were a cement plug 22 is required. In the embodiment shown, a bridge plug 24 is previously located in the well bore 10 at the location for the cement plug 22. The bridge plug 24 is used to provide support to the cement which is deposited as a fluid. The selection of the location may have been made based on cement bond logs to determine the condition and location of cement behind the casing 12.

Referring now to FIG. 1(*b*), cement 22 or other fluidised plugging material is passed down through the casing cutter 18. Of note is that the cement 22 flows through a central bore 26 at the location of the cutters 28 in the casing cutter 18, but the central bore 26 is isolated from the cutting assembly 28, so as to ensure the cement 22, does not pass in or around the cutting assembly. The cement then flows through the stinger 20 and out of an end 30 of the tool string 16. The cement 22 pools into the casing 12, filling the casing 12 from the top of the bridge plug 24 up the well bore 10. The cement 22 is allowed to surround a portion of the stinger 20. Depending on the depth of cement plug required, the tool string 16 can be pulled out of the well bore 10 as the cement 22 continues to flow, at a rate that maintains the end 30 being located in the cement. Care is taken to ensure that while cement can circulate up the annulus 32 between the stinger 20 and the casing 12 it does not pass up the annulus 34 between the cutting assembly 28 and the casing 12.

The quantity of cement required to create a plug 22 of the desired length in the casing 12 will have been calculated and once this quantity has been deposited in the casing 12, the tool string 16 is raised to withdraw the stinger 20 from the cement 22. Use of the stinger 20 prevents debris and other fluids entering the cement and contaminating the cement plug 22. It also provides a greater separation between the end 30 of the tool string 16 and the cutting assembly 28 to limit fowling of the cutting assembly 28.

The tool string 16 can continued to be pulled up until the cutting assembly 28 is positioned at a location where it is desired to cut the casing 12. This is illustrated in FIG. 1(*c*). At this location the cutting assembly 28 is activated and the casing 12 is cut. The cut can be made in any way, for example by slicing, milling, grinding, melting, dissolving or ablation as long as it achieves independent upper 36 and lower 38 lengths of casing 12.

With the casing cut, FIG. 1(*d*), the tool string 16 is raised again to a position to grip the upper 36 length of casing 12. This is best achieved by gripping the length 36 towards its upper end. Pulling the tool string 16 out of the well bore 10 recovers the upper 36 length of casing 12. The wellbore 10 is now left with a permanent barrier, in the form of a cement plug 22, in the casing 12. This is illustrated in FIG. 1(*e*).

All the steps shown in FIGS. 1(*a*) to 1(*c*) have been achieved on a single trip into the well bore 10. In the prior art, this would take three trips into the well bore: to deposit the cement, to cut the casing and to pull the casing. Even were a combined casing and pulling tool is used, we have still saved a further trip into the wellbore.

In alternative embodiments, the method can include further downhole operations performed on the same trip into the well bore.

In a further embodiment, the bridge plug 24 is run on the tool string 16, located via a bridge plug running tool at the end 30 of stinger 20. The bridge plug 24 is set and then disconnected from the tool string 16. The tool string 16 is raised and the cement is deposited as described with reference to FIG. 1.

An alternative arrangement is to make use of a pre-existing cement plug which exists in the casing. In this embodiment, the tool string 16 can include a mill at the end 30. This can dress the existing cement in preparation for the deposit of further cement to make the plug 22.

After the bridge plug 24 is set or on a pre-existing cement plug, an inflow test can be performed using the tool string 16, to save on a further trip into the well bore. This can be achieved by having a resettable packer on the tool string 16. Such an inflow test ensures that there are no leak paths through the bridge plug or pre-existing cement plug.

It will be appreciated that while the preferred plugging material is cement any plugging material which is fluidised to pass the cutting assembly 28 can be used. The tool string 16 may include a chamber for holding plugging material which releases the material through the central bore 26, near the cutting assembly as opposed to being pumped from surface. The quantity of plugging material will be followed by a sponge ball, dart or other isolator to separate the plugging material from the further fluid and ensure the plugging material entirely passes the cutting assembly 28 through the central bore. When a sponge ball or dart is used, the wall of the central bore will advantageously be cleaned to prevent plugging material entering the cutting assembly if a passageway is opened up therebetween when the cutting assembly is actuated.

A wash tool can also be incorporated in the tool string to flush or circulate fluid in the central bore and casing to wash away debris in advance of cementing or when the cutting assembly is operating to carry off cutting debris.

If desired the method can include the step of pulling the casing before the cut is made. This holds the casing 12 in tension and can aid the cutting process as it assists in getting the upper 36 and lower 38 lengths of casing to separate.

If the upper 36 length of casing cannot be pulled after cutting, due most likely to cement or other debris being present behind the casing, the grips at FIG. 1(*d*) can be retracted and the tools string raised to position the cutting assembly 28 at a shallower location. The casing can be cut higher up and a smaller upper length of casing removed. This can advantageously be performed on the same trip into the well.

Figure 2:
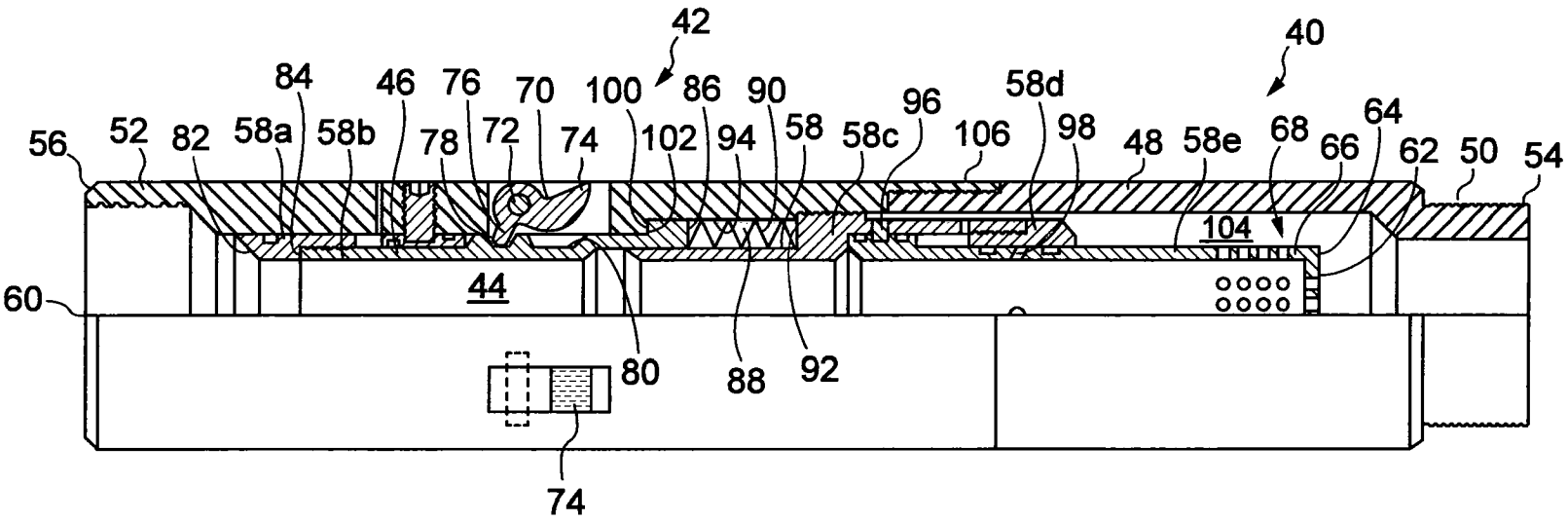
FIG. 2 is an illustration of a casing cutter, in a first configuration for running in a well and passing fluidised plugging material through the casing cutter, according to an embodiment of the present invention.

Reference is now made to FIG. 2 of the drawings which illustrates a casing cutter, generally indicated by reference numeral 40, having a cutting assembly 42 isolated from a central though bore 44 by a wall 46, according to an embodiment of the present invention.

Casing cutter 40 has a cylindrical body 48 with standard pin 50 and box section 52 fittings for connection in a tool string (not shown), at first 54 and second ends 56, respectively. The first end 54 is connected to a stinger, see FIG. 6. Within the tubular body 48 there is located a sleeve 58 connected in parts 58*a-e* for assembly. The sleeve 58 defines a central through bore 44 along a majority of its length. The through bore 44 gives an uninterrupted flow path along the central axis 60 of the body 48 past the cutting assembly 42. Sleeve 58*b* provides the wall 46 to isolate the cutting assembly 42 from the central bore 44.

At a first end 62 of the sleeve 58, part 58*e*, the sleeve has an end face 64. The end face 64 and a portion of the sleeve 58 at the first end 62 is perforated to provide large by-pass holes 66 for non-restricted flow of a plugging material i.e. cement through the sleeve from the second end 60 to the first end 54 of the tool body 48, while providing a catcher 68.

In the tool body 48, there is a cutting assembly 42. Cutting assembly comprises a plurality of cutting elements 70 (one shown). Each cutting element 70 is sized to be entirely contained within the tool body 48. The cutting element 70 is mounted on a pivot 72 so that the element 70 can swing outwards of the tool body 48 to present a tungsten carbide tipped cutting surface 74 to cut casing (not shown). Opposite the cutting surface is a lever 76. Lever 76 is a protrusion from the cutting element 70 which engages with a groove 78 on an outer surface 80 of the sleeve part 58*b*.

At the second end 84 of sleeve part 58*b*, there is attached sleeve part 58*a* which presents a shoulder 82 facing the second end 56 to the tool body 48. At the first end 86 of sleeve part 58*b*, there is a chamber 88 which contains a disc spring 90. The chamber 88 is created between the first end 86, a corner on outer surface 92 of sleeve part 58*c* and an inner surface 94 of the tool body 48. Sleeve part 58*c* is attached to the tool body 48 and releasably attached, by a shear pin 96, to the sleeve part 58*e*. Sleeve part 58*e* has a four ports 98 (one shown) in addition to the bypass holes 66, located a length from the catcher 68.

The casing cutter 40, as shown in FIG. 1, is in a first configuration. In this configuration the cutting elements 70 are held in the retracted position within the tool body 48. This is achieved by the action of the spring 90 pushing sleeve part 58*b* towards the second end 56, which consequently moves the lever 76 towards the second end 56 by virtue of its location in the groove 78. Travel of the sleeve part 58*a* is limited by a stop 100 on the tool body 48 contacting a shoulder 102 on the inner surface 80 of the sleeve part 58*a*. Sleeve part 58*b*, provides a wall 46 between the cutting elements 70 and the central bore 48. In this configuration the ports 98 are blocked by the sleeve part 58*a*, to ensure that no open fluid passageway exists between the cutting assembly 42 and the central bore 44. Additionally no open fluid passageway exists between the central bore 44 and an outer surface 106 of the tool body 48. An annulus 104 between the catcher 68 and the inner surface 94 of the tool body 48 assists in allowing fluid passage through all the bypass holes 66 in the catcher 68. Thus the cutting assembly is isolated from the central through bore 44 by the wall 46.

The casing cutter 40 can be run into a well, as described with reference to FIG. 1(*a*), and a plugging material pumped through the central bore, with reference to FIG. 1(*b*), while in the first configuration. The large bypass holes 66, having an overall cross-sectional area greater than the cross sectional area of the central bore 44 in sleeve part 58*b*, allow the cement to pass through the tool body from the second end 56 to the first end 54 and on through the stinger, see FIG. 6.

Once depositing of the plugging material is complete and a plug has been formed in the casing, the tool string is moved and the casing cutter positioned to perform cutting of the casing above the plug, as described hereinbefore with reference to FIG. 1(*c*).

Figure 3:
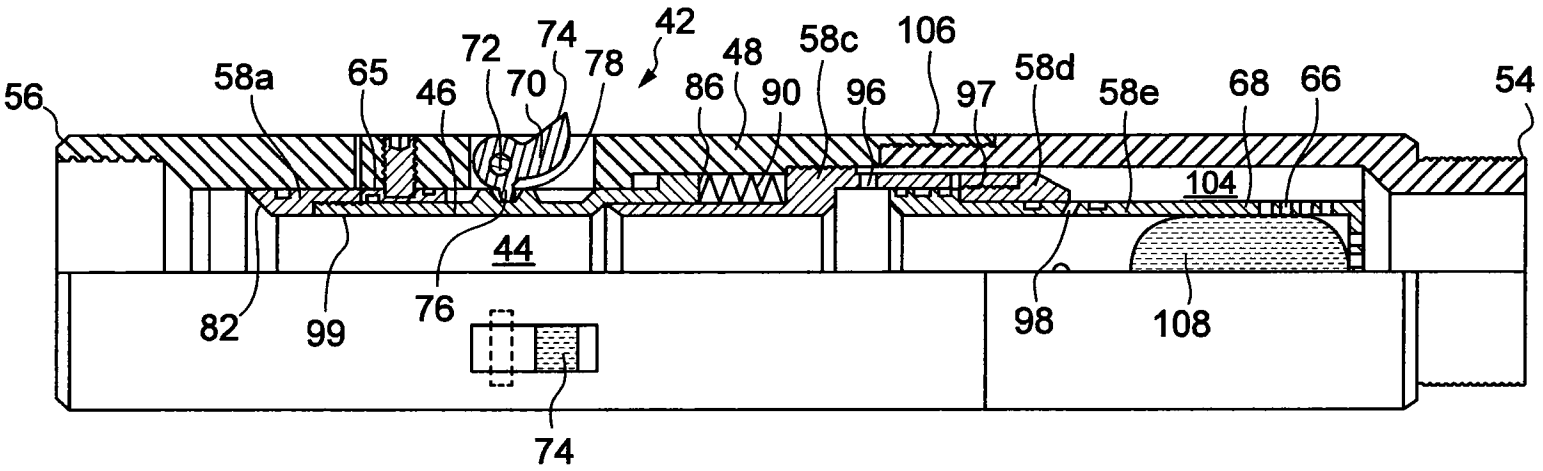
FIG. 3 is the casing cutter of FIG. 2, now in a second configuration for cutting casing.

The casing cutter 40, is now activated to a second configuration, shown in FIG. 3. In FIG. 3, like parts to those used in FIG. 2 have been given the same reference numeral to aid clarity.

Activation of the casing cutter 40 is achieved by creating a choke within the cutter 40. A sponge ball 108 is pumped through the tool string to act as a separation device between the cement and circulating fluid. The sponge ball 108 will clean the inner surface 89 of the central bore 44 and be held in the catcher 68. The sponge ball 108 is sized so that it covers all the large bypass holes 66 in the catcher 68 consequently blocking fluid passage through the central bore 44 and indeed the casing cutter 40. By the continued pumping of fluid behind the ball 108, sufficient pressure is created to shear pin 96 between sleeve parts 58*c*,58*e*. As sleeve part 58*c* is held to the tool body 48, sleeve part 58*e* moves towards the first end 54 and exposes ports 98 to create an open fluid passageway between the central bore 44 and the annulus 104. Sleeve part 58*d* attached to sleeve part 58*c* provides a shoulder 97 to prevent sleeve part 58*e* exiting the tool body 48.

The cross sectional flow area through the ports 98 is appreciably smaller than the cross sectional flow are through the central bore 44 and consequently a choke is formed. Continued pumping of fluid through the casing cutter 40 will now act on the shoulder 82 of the first sleeve part 58*a*. This pushes sleeve part 58*b* downwards against the disc spring 90 via face 86. This movement of the sleeve part 58*b* relocates the groove 78 taking the lever 76 towards the first end 54 too. Lever 76 causes turning of the cutting element 70 on pivot 72 to move the cutting surface 74 radially outwards from an outer surface 106 of the tool body 48 to contact and cut casing 12, as shown in FIG. 1(*c*). Constant pressure maintains contact of the cutting surface 74 on the casing to cut the casing. Once the casing has been cut, further radial extension of the cutting element 70 is limited by the sleeve part 58*b* being halted by sleeve 58*a* meeting stop 65. Cutting is achieved by rotation of the tool body 48 on the tool string. This cutting action only requires rotation of the tool string from the surface of the well. There is no motor needed to rotate the cutting assembly, thus a motor and in particular a motor through which cement can be pumped, is advantageously not required, reducing cost and complexity.

In this configuration the casing is cut and fluid can be pumped through the central bore 44, the ports 98 and the stinger to be circulated up the annulus between the casing cutter and the casing being cut. This lifts cuttings to surface. When cutting is complete, turning the pumps off will cause the spring 90 to return the sleeve part 58*a* to the first configuration and the cutting members 70 will be retracted into the tool body 48. This is as shown in FIG. 1(*d*) were the tool string is used to perform further operations in the well bore.

It is noted that for the casing cutter 40 shown in FIGS. 2 and 3, the wall 46 is always in place to isolate the cutting members 70 from the central bore 44 and no open fluid passageway exits from the central bore to the outer surface 106 of the tool body 48.

Figure 4:
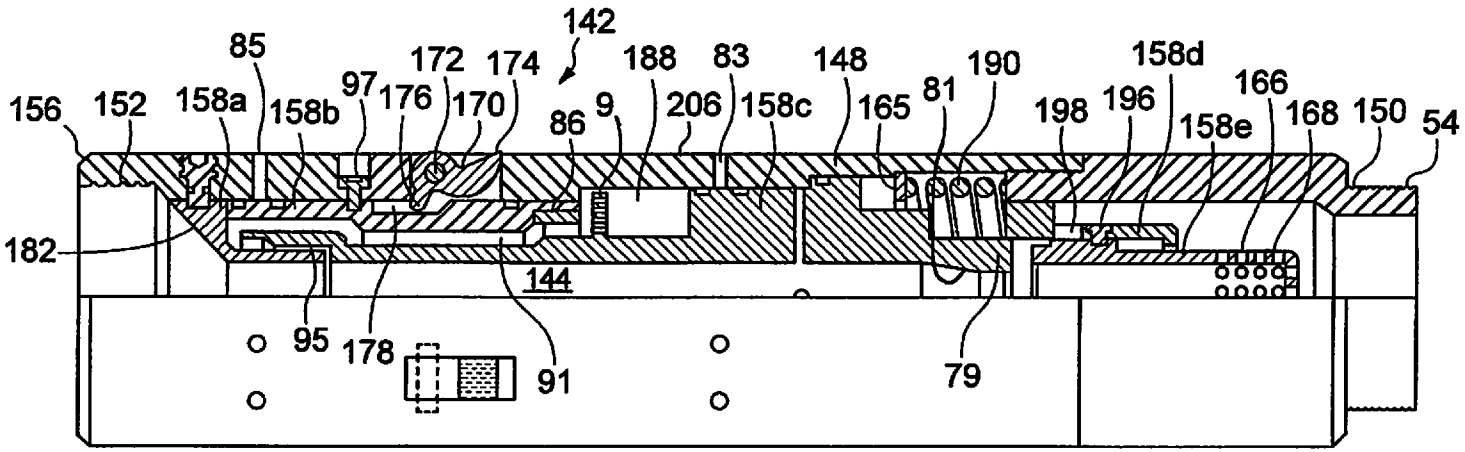
FIG. 4 is an illustration of a casing cutter, in a first configuration for running in a well and passing fluidised plugging material through the casing cutter, according to a further embodiment of the present invention.

In casing cutting it may be preferred to have fluid exit at or adjacent the cutting members to sweep cuttings and debris away from the cutting site. This open fluid passageway may also be used to lubricate the cutting members. Reference is now made to FIG. 4 of the drawings which illustrates a casing cutter, generally indicated by reference numeral 140, which includes this feature, according to a further embodiment of the present invention. In FIG. 4, like parts to those in FIGS. 2 and 3 have been given the same reference numeral but with the addition of 100.

In this casing cutter 140, sleeve part 158*b* still acts as the wall to isolate the cutting assembly 142 from the central bore 144, with the cutting assembly 142 having identical cutting elements 170 operated in a similar fashion by a lever 176 being shifted within a groove 178, though the groove 178 in sleeve part 158 is, by necessity, longer. The cutting elements 170 still reside within the tool body 148, in the first configuration shown in FIG. 4.

Sleeve part 158*a* includes the shoulder 182 but this sleeve part no longer moves on activation. Sleeve part 158*a* now extends along the central bore 144 to create a narrow annular open fluid passageway 95 with sleeve part 158*c*. It is also no longer attached to sleeve part 58*b*, and is instead attached to sleeve part 158*c* at the first end 186. Sleeve part 158*b* sits between a portion of sleeve part 158*c* and the inner surface of the tubular body 148, there being an open fluid passageway 91 between the portion of sleeve part 158*c* and the outer surface 93 of the sleeve part 158*b* which meets the narrow passageway 95 to access the central bore 144.

The chamber 188 now contains a screen 9 to filter debris from fluid which is allowed to flow into the passageway 91. Debris will be held in the chamber 188. Spring 190 is now a coil spring located in an open compartment between sleeve parts 158*c* and 158*d* with access to the central bore 144.

Sleeve 158*e* has the same arrangement with the catcher 168 and large bypass holes 166. The ports 198 have, however been removed and are now located on sleeve 158*d*. The shear pin 196 has now moved to be between sleeve parts 158*d* and 158*e* with an additional shear pin 97 between the tubular body 148 and the sleeve part 158*b*.

Additional features include upper 85 and lower 83 ports through the tubular body 148 on either side of the cutting assembly 148, and a drop ball seat 81 at a first end of the sleeve part 158*c*.

In the first configuration for run in and cementing, as shown in FIG. 4, the sleeve part 158*a* acting as the wall 146 is held across the cutting assembly 142 by virtue of the shear pin 97. Sleeve part 158*b* also covers the upper ports 85. As sleeve part 158*b* is fixed to sleeve part 158*c*, the lower ports 83 are covered by sleeve part 158*c*. Thus on run in and cementing there are no open fluid passageways between the central bore 144 and an outer surface 206 of the tool body 148.

The first sleeve part 158*a* and third sleeve part 158*c* overlap forming a narrow annular passageway 95 providing a venturi choke. Spring 190 is in an expanded condition. Sleeve part 158*e* with the catcher is held to sleeve part 158*d* by shear pin 196 and held in a position to cover the ports 198 in sleeve part 158*d*.

Cement or other plugging material can pass from the second end 156 to the first end 154 through a central bore 144 to provide sufficient cement for a plug to be created in a timely manner.

The casing cutter 140 can be run into a well, as described with reference to FIG. 1(*a*), and a plugging material pumped through the central bore, with reference to FIG. 1(*b*), while in the first configuration. The large bypass holes 166, having an overall cross-sectional area greater than the cross sectional area of the central bore 144 in sleeve part 158*c*, allow the cement to pass through the tool body from the second end 156 to the first end 154 and on through the stinger, see FIG. 6.

Once depositing of the plugging material is complete and a plug has been formed in the casing, the tool string is moved and the casing cutter positioned to perform cutting of the casing above the plug, as described hereinbefore with reference to FIG. 1(*c*).

Figure 5:
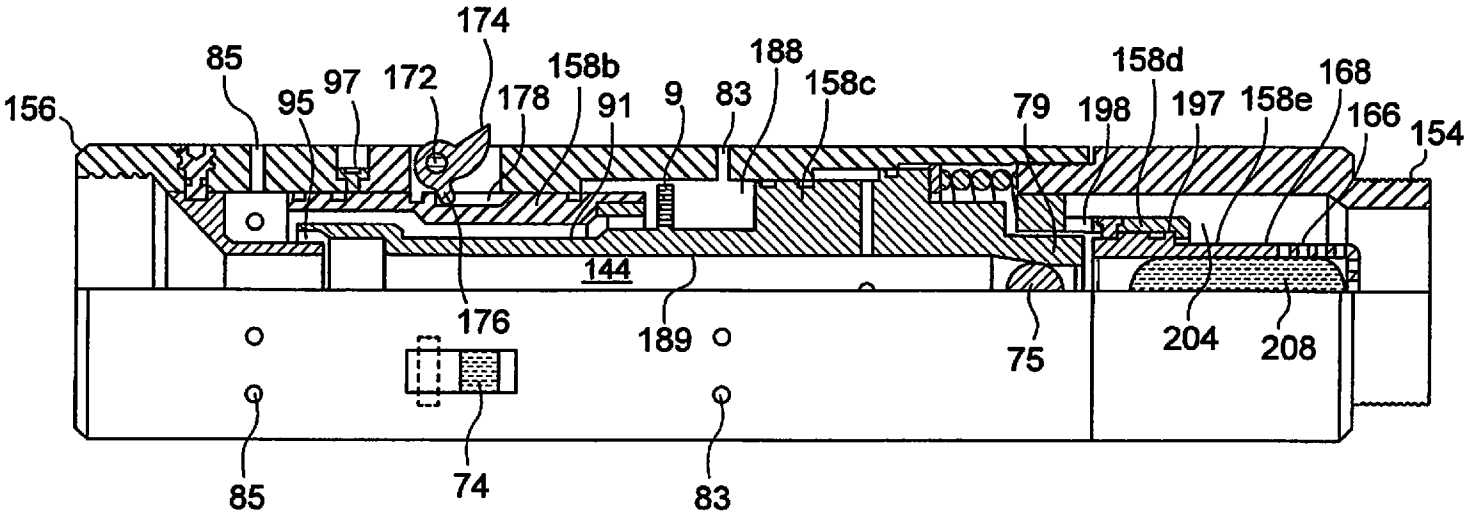
FIG. 5 is the casing cutter of FIG. 4, now in a second configuration for cutting casing.

The casing cutter 140, is now activated to a second configuration, shown in FIG. 5. In FIG. 5, like parts to those used in FIG. 4 have been given the same reference numeral to aid clarity.

Activation of the casing cutter 140 is achieved by creating a choke within the cutter 140. A sponge ball 208 is pumped through the tool string to act as a separation device between the cement and circulating fluid. The sponge ball 208 will clean the inner surface 189 of the central bore 144 and be held in the catcher 168. The sponge ball 208 is sized so that it covers all the large bypass holes 166 in the catcher 168 consequently blocking fluid passage through the central bore 144 and indeed the casing cutter 140. By the continued pumping of fluid behind the ball 208, sufficient pressure is created to shear pin 196 between sleeve parts 158*d*,158*e*. As sleeve part 158*d* is held to the tool body 148, sleeve part 158*e* moves towards the first end 154 and exposes ports 198 to create an open fluid passageway between the central bore 144 and the annulus 204. Sleeve part 158*d* provides a shoulder 197 to prevent sleeve part 158*e* exiting the tool body 148.

Now fluid can pass through the central bore 144, the ports 198 and annulus 204 to exit the tool body and enter the stinger. Fluid pressure can no longer be used to move sleeve 158*b* as it is now held in place by the shear pin 97.

To move the casing cutter 140 to a second configuration and cut casing, requires a drop ball 75 to be pumped through the central bore 144. Drop ball 75 will seat in the drop ball seat 79 blocking the central bore 144 and prevent fluid passing through ports 198. Pressurising up behind the ball 75 will cause shearing of pin 97 by virtue of the connection between sleeve parts 158*b* and 158*c*. These sleeve parts 158*b*,158*c* will move down against the spring 190, thereby moving the lever 176 as the groove 178 is moved towards the first end 154. Lever 176 causes turning of the cutting element 170 on pivot 172 to move the cutting surface 174 radially outwards from an outer surface 206 of the tool body 148 to contact and cut casing 12, as shown in FIG. 1(*c*). Once the cut is complete, further radial movement of the cutting surface 176 is prevented as downward movement of the sleeve part 158*b* is halted by sleeve 158*c* meeting stop 165, now located at the spring 190. This keeps the cutter surface 174 in a fixed position. Cutting is achieved by rotation of the tool body 148 on the tool string.

Movement of the sleeve parts 158*b,c* expose upper 85 and lower ports 83 on either side of the cutting assembly 142. Fluid can now flow from the central bore 144, through passageway 95 and out of port 85 to the outer surface 206 of the tool body 148. Indeed, this is the only fluid flow path available to fluid pumped through the tool string to the casing cutter 140. This fluid flow path acts as a venturi producing a pressure drop across the end of passageway 91 thereby drawing fluid from passageway 91 out through port 85. With lower ports 83 now open into the chamber 188 there is an open fluid passageway from the outer surface 206 of the tool body 148, through ports 83, into chamber 188 to be screened by filter 98 and pass into passageway 91. As the venturi action draws fluid through passageway 91, it will draw fluid from the port 83, down the outer surface 206 of the tool body 148 and into the chamber 188. This is a reverse circulation path which will move the cuttings, swarf and debris towards the first end 154 of the casing cutter 140 rather than bringing them to surface. The cuttings, swarf and debris may fall out of the fluid in the annulus between the tool body 148 and the casing (Reference 34 in FIG. 1(*b*)) and be left in the well. Some will enter the port 83 and then be trapped in the chamber 188 by action of the filter screen 98.

In this configuration the casing is cut and fluid can be pumped through the tool string to exit the casing cutter at ports at or adjacent to the cutting members. This advantageously creates reverse circulation to collect debris and/or leave it in the well and not have to be brought to surface for disposal. When cutting is complete, turning the pumps off will cause the spring 190 to return the sleeve parts 158*b*, 158*c* to the first configuration and the cutting members 170 will be retracted into the tool body 148. This is as shown in FIG. 1(*d*) were the tool string is used to perform further operations in the well bore. These operations will, of course, be limited by the presence of the drop ball 75 blocking the throughbore of the tool string at the location of the casing cutter 140.

Figure 6:
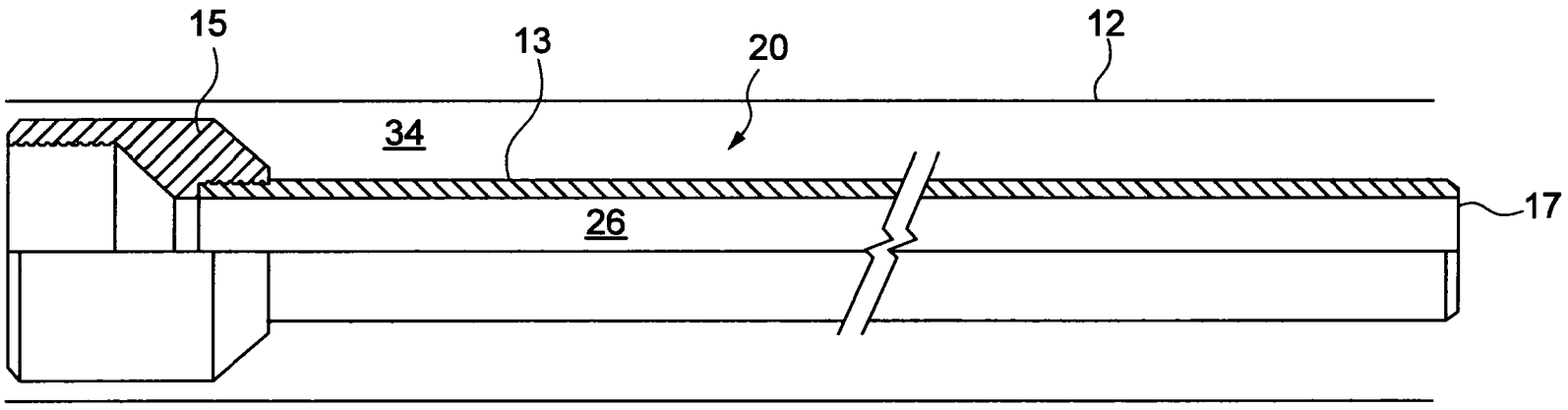
FIG. 6 is an illustration of a stinger for use with the casing cutters of FIGS. 2 to 5.

Reference is now made to FIG. 6 of the drawings which illustrates a stinger, generally indicated by reference numeral 20, which will be attached to the pin section 50,150 of the casing cutter 40,140 at the end of a tool string according to the present invention. Like parts to those of FIGS. 1(*a*) to (*e*) have been given the same reference numerals to aid clarity.

Stinger 20 has a cylindrical body 13 attached to a box section 15 for connection to the pin section 50,152 at the first end 54,154 of a casing cutter 40,140. It has an open end 17 opposite the box section 15. The central bore 26 is kept as large as possible and preferably at least as large as the central bore through the rest of the tool string 16. This is to avoid creating a choke for the passage of the fluidised plugging material. More particularly, the outer diameter of the body 13 is also kept as small as possible, resulting in the body 13 being thin-walled. This is done in order to gain the greatest possible cross sectional flow area in the annulus 34. The diameter of the stinger 20 is selected to be less than half the diameter of the casing in which it is inserted. Additionally the length of the tubular body 13 is at least the length of the casing cutter. Preferably the length of the body 13 is selected to be the length of the desired cement plus a margin of error, say 20%. The body 13 may have a length of at least 15 metres, 30 metres, 100 metres or more preferably around 200 metres to in excess of 500 metres.

The length provides separation between the plugging material and the cutting assembly of the casing cutter. This arrangement also ensures that when the stinger 20 is drawn out of the reservoir of fluidised plugging material forming the plug, pressure in the central bore 26 and in the annulus 34 above the level of the plugging material is balanced. This prevents debris in the annulus 34 being drawn into the fluidised plugging material which could affect the integrity of the plug formed. Equally, it prevents material in the central bore being drawn in and mixed with the plugging material which could cause similar integrity problems with the plug.

The principle advantage of the present invention is that it provides a method of cementing and cutting casing in a single trip into a well bore.

A further advantage of the present invention is that it provides a casing cutter through which cement can be pumped via a central bore while protecting the cutting assembly from the cement.

It will be apparent to those skilled in the art that modifications may be made to the invention herein described without departing from the scope thereof. For example, other actuation mechanisms can be designed to activate the cutter assembly, such as hydro-mechanical and electrical.

I claim:

1. A method comprising, in a single trip in a well bore, the steps:

(a) running a tool string downhole in the well bore, the tool string including a casing cutter and a stinger;

(b) passing a fluidised plugging material through the casing cutter and the stinger to deposit a quantity of the fluidised plugging material into the well bore to form a plug;

(c) drawing the stinger out of at least a portion of the deposited fluidised plugging material; and (d) using the casing cutter to part an upper length of casing from a lower length of casing.

2. A method according to claim 1 wherein the method includes the step of pulling the upper length of casing on the same trip into the well bore.

3. A method according to claim 1 wherein the method includes the step of continuing to pull the tool string after step (c) to position the casing cutter at a desired location for step (d).

4. A method according to claim 1 wherein the method includes the additional steps of including a bridge plug on the tool string and setting the bridge plug in the well bore before step (b).

5. A method according to claim 1 wherein the method includes the step of conducting an inflow test before step (b).

6. A method according to claim 1 wherein step (b) includes pumping the fluidised plugging material from surface.

7. A method according to claim 1 wherein the tool string includes a receptacle for holding a plugging material and step (c) includes releasing the plugging material from the receptacle to pass as fluidised plugging material through the casing cutter.

8. A method according to claim 1 wherein the method includes the step of pumping a separation member behind the quantity of the fluidised plugging material.

9. A method according to claim 1 wherein the method includes pumping a wash fluid through the tool string and casing cutter.

10. A method according to claim 9 wherein the method includes directing at least a portion of the wash fluid through at least one port in the casing cutter.

11. A method according to claim 1 wherein the method includes the step of pulling the casing between steps (c) and (d).

12. A method according to claim 1 wherein in step (d) the casing is severed by making a circumferential cut through the casing.

13. A method according to claim 1 wherein in step (d) the casing is milled over a length of the casing.

14. A method according to claim 1 wherein the method includes the further steps of pulling the tool string to a second location, at a shallower depth, in the well and repeating step (d).

* * * * *